US006062503A

United States Patent [19]

Blair et al.

[11] Patent Number: 6,062,503

[45] Date of Patent: May 16, 2000

[54] APPARATUS AND METHODS FOR HOSE STORAGE

[75] Inventors: William Blake Blair, Alachua; Daniel Godfrey, High Springs, both of Fla.

[73] Assignee: Fast Basket, Inc., Alachua, Fla.

[21] Appl. No.: 09/096,951

[22] Filed: Jun. 12, 1998

Related U.S. Application Data

[63] Continuation-in-part of application No. 08/663,564, Jun. 13, 1996, abandoned.

[51] Int. Cl.[7] ..... B65H 75/38; B65H 16/00; B65H 16/02; B65D 6/08

[52] U.S. Cl. ..... 242/387; 242/588; 242/588.2; 242/590; 242/594; 220/491

[58] Field of Search ..... 242/387, 604, 242/604.1, 388.9, 388.91, 588, 588.2, 590, 594; 220/485, 491

[56] References Cited

U.S. PATENT DOCUMENTS

| | | | |
|---|---|---|---|
| 2,300,243 | 10/1942 | Zierden | 242/387 |
| 2,540,434 | 2/1951 | Fengler | 242/387 |
| 3,039,715 | 6/1962 | Caperton | 242/387 |
| 3,464,076 | 9/1969 | Ciaccio | 242/387 |
| 3,928,885 | 12/1975 | Peterson et al. | 242/387 |
| 5,243,761 | 9/1993 | Sullivan et al. | 30/134 |
| 5,297,780 | 3/1994 | Hickerson | 254/124 |
| 5,421,533 | 6/1995 | Scott et al. | 242/405.3 |

*Primary Examiner*—John Q. Nguyen
*Attorney, Agent, or Firm*—Saliwanchik, Lloyd & Saliwanchik

[57] ABSTRACT

A hose storage device that can be removably or permanently attached to a vehicle or to the frame unit of a portable power unit, such as those used with hydraulic rescue tools for the extrication of persons trapped in automobiles, trailers, buildings, etc. One or more of the devices can be used with a single power unit depending on the number of hoses to be used with the power unit. Hose storage devices are lightweight, durable and help prevent the damage to hoses that can result from other storage systems.

20 Claims, 10 Drawing Sheets

APPARATUS AND METHODS FOR HOSE STORAGE

CROSS-REFERENCE TO RELATED APPLICATION

This application is a continuation-in-part of U.S. application Ser. No. 08/663,564 filed Jun. 13, 1996, abandoned.

FIELD OF INVENTION

This invention relates to devices and methods for management of hoses, cords and the like, particularly those used with hydraulic rescue tools.

BACKGROUND OF THE INVENTION

Rescue personnel such as firemen, police, paramedics and others typically rely on portable rescue units which are equipped with tools which are capable of generating the cutting, spreading, and/or closing forces required for opening, ripping, and cutting through crushed metal and the like in order to extricate victims from accidents in which the victim is trapped in a car, trailer, etc. These rescue units are powered by gasoline or electric motors which are capable of generating substantial pneumatic or hydraulic forces which drive specially designed cutting or spreading devices commonly referred to as "jaws of life" devices. See, for example, U.S. Pat. No. 5,243,761 which discloses a rescue cutting tool.

Rescue units typically comprise a positive displacement hydraulic pump which is driven by a power unit such as a gasoline engine. In the case of hydraulic rescue devices, a hydraulic hose line, consisting of a supply line and a return line is connected to the hydraulic pump. Many rescue units are designed to be portable in nature in order to provide for more rapid deployment to an accident site. Therefore, the power unit, the pump and connectors for the hose lines are usually housed in a compact tubular metal flame or cradle that surrounds the power unit and to which the power unit is mounted. In use, the hydraulic hose supply and return lines are connected to a rescue tool. A rescue unit may also be equipped for use with more than one hydraulic hose line to allow for the simultaneous use of two or more rescue tools.

When not in use, portable rescue units are usually stored in a compartment on a rescue vehicle. The associated hydraulic hoses are typically coiled and placed on a hook that is attached to the rescue unit. In other cases, the hose is simply placed loosely into the storage compartment along with the portable rescue unit, or is strapped to the portable rescue unit frame through accessory cords. However, improper hose management and storage methods, such as the above, can result in kinks or compression in the hose, abrasions to the hose, and other damage, such as from burns when the hose rests against a hot component of the power unit. Damaged hose may result in a malfunction or failure of the rescue tool during an emergency situation. These forms of hose storage also require significantly longer periods of time for deployment and untangling of the hose for use at an accident scene. For example, where the hose is stored as a loose coil, in order to set up and operate the portable rescue unit at an accident, the hose must be removed from the storage compartment, uncoiled and untangled over the length of the hose, and the supply and return hose lines hooked to the connections at both the pump and at the rescue tool device. Uncoiling and untangling the hose lines and making the proper connections can take several additional minutes before the rescue tool can be placed in operation.

Although reel-type hose storage systems are available, such as those manufactured by Hannay Reels (Westerlo, N.Y.), this type of hose management system is not particularly suitable for use with portable rescue units due to its size and weight. Moreover, reel-type hose storage devices are relatively expensive and contain numerous moving parts that can wear out or break. U.S. Pat. No. 5,421,533 discloses a reel-type water hose winding apparatus that can be carried and operated by an individual.

As can be understood from the above, there remains a need in the art for a more efficient means of storage for hoses and lines associated with portable power units used with rescue tools and the like. The compact, lightweight hose storage apparatus of the present invention advantageously provides for reduced damage to hydraulic hoses, and for rapid deployment and efficient storage of hoses and lines. In addition, the hose storage apparatus can be inexpensively manufactured and readily adapted to commercially available rescue units.

BRIEF SUMMARY OF THE INVENTION

The subject invention concerns novel devices and methods for storage of hydraulic hoses and the like with their associated power units. Specifically, the invention concerns a storage apparatus that can be specifically adapted for and removably mounted to a frame member of a portable power unit. A hose storage device of the present invention can be adaptably mounted on equipment frames such as those used with hydraulic rescue units, high-pressure washers, and other similar equipment. The subject invention provides a lightweight and inexpensive apparatus that can be used with a variety of hoses, including pneumatic, hydraulic, high-pressure water and steam hoses. The subject apparatus can also be used for storage of electrical cords and the like. The present invention provides a means for the convenient and space-efficient storage of these hoses and provides for rapid deployment and access to such hoses. Advantageously, use of the present hose storage apparatus with a hydraulic rescue unit allows the hydraulic hose lines to remain coupled to the power unit during storage and transport, thereby obviating the time-consuming task of connecting the hoses to the unit at an accident site. In addition, use of the apparatus avoids the damage to hoses, such as kinks, abrasions and burns, that can result from improper hose management and storage. The subject invention further concerns methods and materials for managing the storage and rapid deployment of hoses.

DETAILED DESCRIPTION OF THE INVENTION

The present invention concerns novel devices that can be used for the efficient storage and deployment of hoses from a portable power unit, such as those used with a rescue unit. The subject devices can save valuable minutes in setting up the rescue unit and deploying rescue tools in emergency situations, a feature which is particularly important in those situations that require rapid extrication of an accident victim from a damaged vehicle or structure. A hose storage device of the present invention is specifically adapted to be attached or mounted onto the metal frame or support cradle of a portable power unit. The hose storage devices of the invention can also be directly mounted onto a rescue vehicle, such as a utility compartment of the vehicle. A hose storage device can be removably attached to the power unit frame, or substantially permanently mounted on the frame, by means such as by welding.

A hose storage apparatus of the subject invention comprises an upper frame member that forms a substantially ring-like or loop structure. The bottom portion or base of the apparatus is defined by a support member having both substantially vertical and horizontal sections, and first and second ends which are directly attached to the upper frame member. In a preferred embodiment, the support member(s) may be substantially U-shaped and/or C-shaped. When constructed according to the teachings of the present invention, the upper frame member and support members form a "basket" in which a length of hose can be coiled and stored and, when the situation requires it, rapidly and efficiently deployed.

Figure 1:
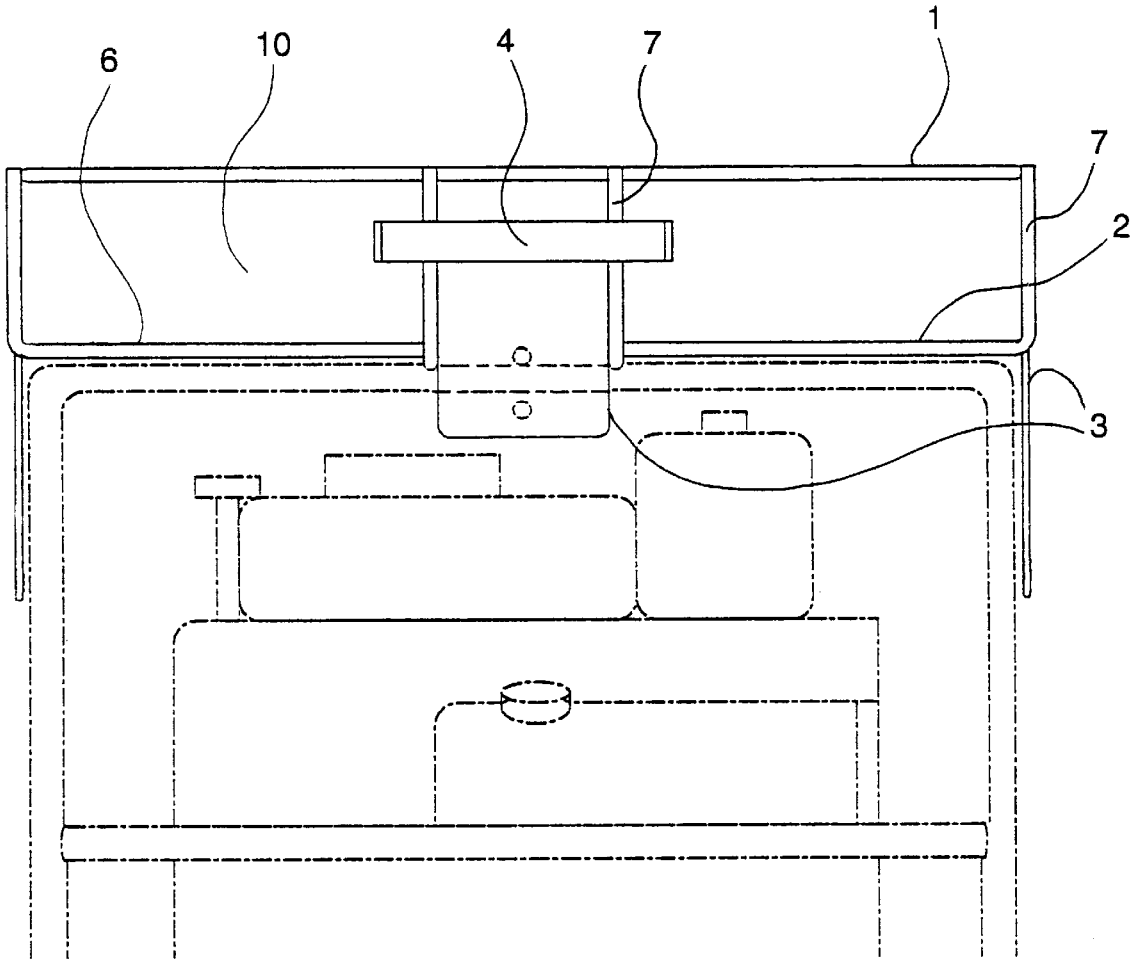
FIG. 1 is a side view of a first embodiment of a hose storage apparatus of the present invention as shown mounted on the outline of a frame of a power unit.
Figure 2:
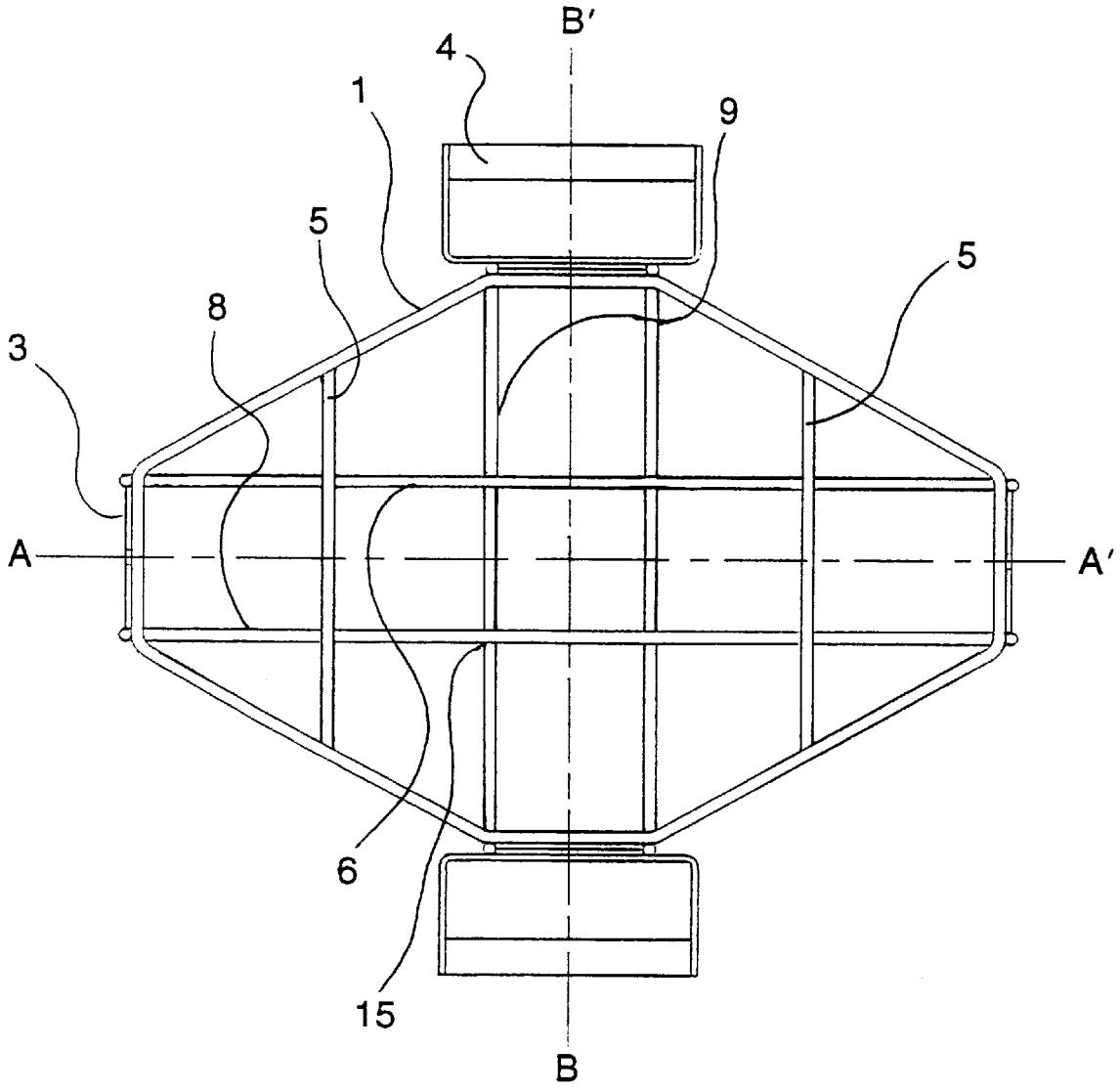
FIG. 2 is a top view of a first embodiment of a hose storage apparatus of the present invention.
Figure 3:
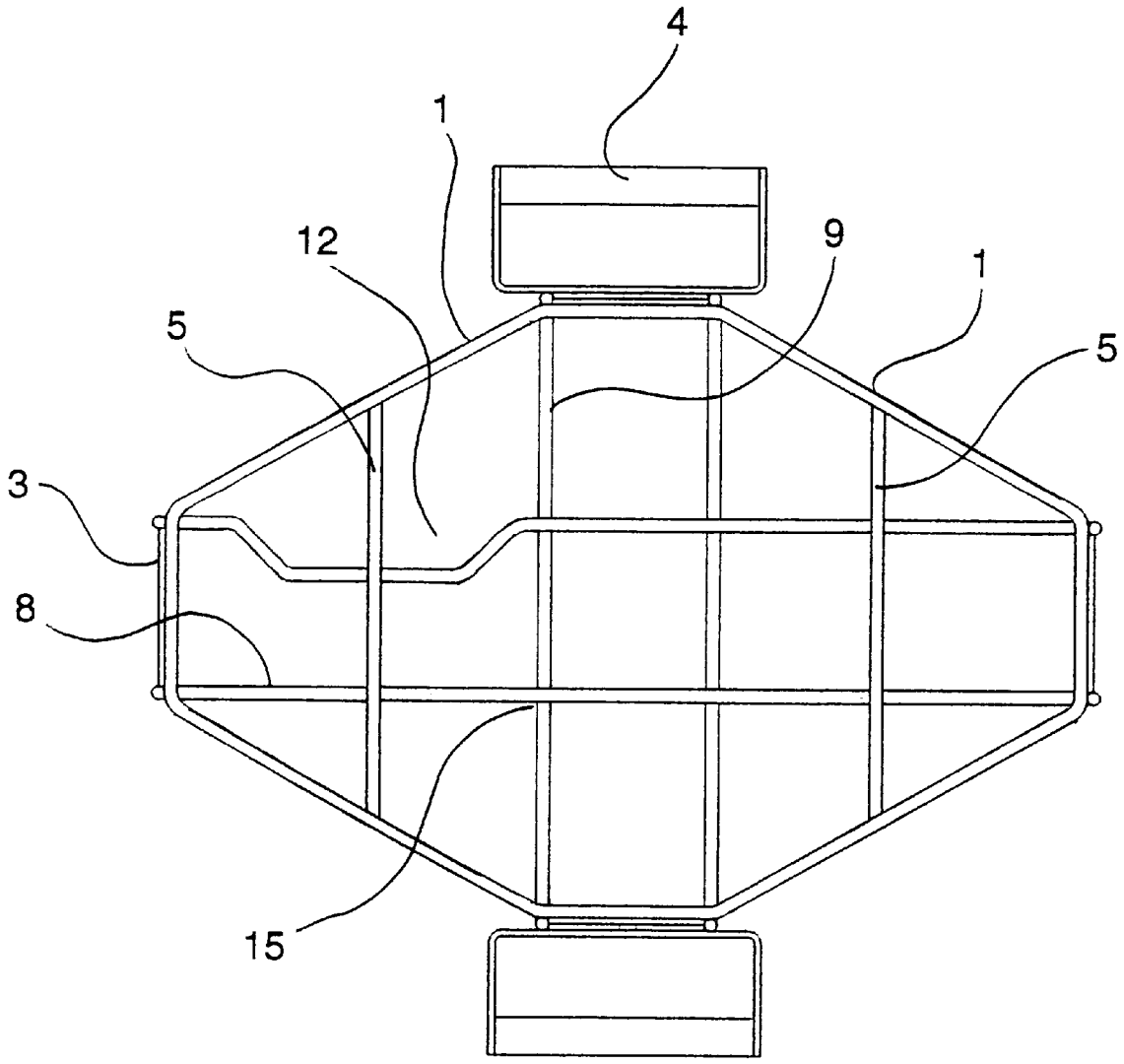
FIG. 3 is a top view of a first embodiment of a hose storage apparatus of the present invention having an alternate configuration of a U-shaped support member.

With reference to FIGS. 1–5, a single basket hose storage apparatus of the present invention comprises an upper frame member 1 that forms a closed ring. Preferably, the upper frame member forms a substantially circular, oval, diamond, hexagonal, or octagonal ring. In an exemplified embodiment, the upper frame member 1 has a long axis (shown as A–A' on FIG. 2) and a short axis (shown as B–B' on FIG. 2), wherein the short axis is coplanar with the long axis. An octagonal-shaped upper frame member 1 is illustrated herein. The base 10 of the hose storage apparatus is defined by a substantially U-shaped support member 2 having a first and second end, wherein the first and second ends of the U-shaped support member 2 are attached to the upper frame member 1. Typically, the horizontal section 6 of the U-shaped support member 2 is of greater length than the vertically oriented section 7 of the U-shaped support member 2. The horizontal section 6 of a U-shaped support member 2 can be substantially straight (as shown in FIG. 2), or it may also be curved or bent at certain portions 12 (as shown in FIG. 3) to allow for easier access to certain areas of the power unit. As illustrated in the figures, multiple U-shaped support members 2 can be used in combination to define the base 10 of the hose storage apparatus. Preferably, at least two U-shaped support members 2 comprise the base 10 of the hose storage apparatus. As used herein, the terms "horizontal," "horizontally oriented," "vertical," "vertically oriented" and "upper" refer to positional representations based on side views of a subject apparatus of the present invention, as depicted, for example, in FIGS. 1 and 4.

In one embodiment of a single basket hose storage apparatus, at least a first U-shaped support member 8 is in substantial axial alignment with the long axis of the upper frame member 1 and at least a second U-shaped support member 9 is in substantial axial alignment with the short axis of the upper frame member 1 (See FIGS. 2 and 5), such that the horizontal section of the first and second U-shaped support members are substantially in parallel plane or coplanar and in perpendicular relation to each other. More preferably, the base comprises at least four U-shaped support members 2, and at least two of the U-shaped support members are in substantial axial alignment with the long axis of the upper frame member and at least another two U-shaped support members are in substantial axial alignment with the short axis of the upper frame member. Optionally, a point of intersection 15 between at least a first U-shaped support member 8 and at least a second U-shaped support member 9 can be welded or fastened together using conventional means. Typically, the points of intersection between any U-shaped support member with any other U-shaped support member are connected together.

Figure 6:
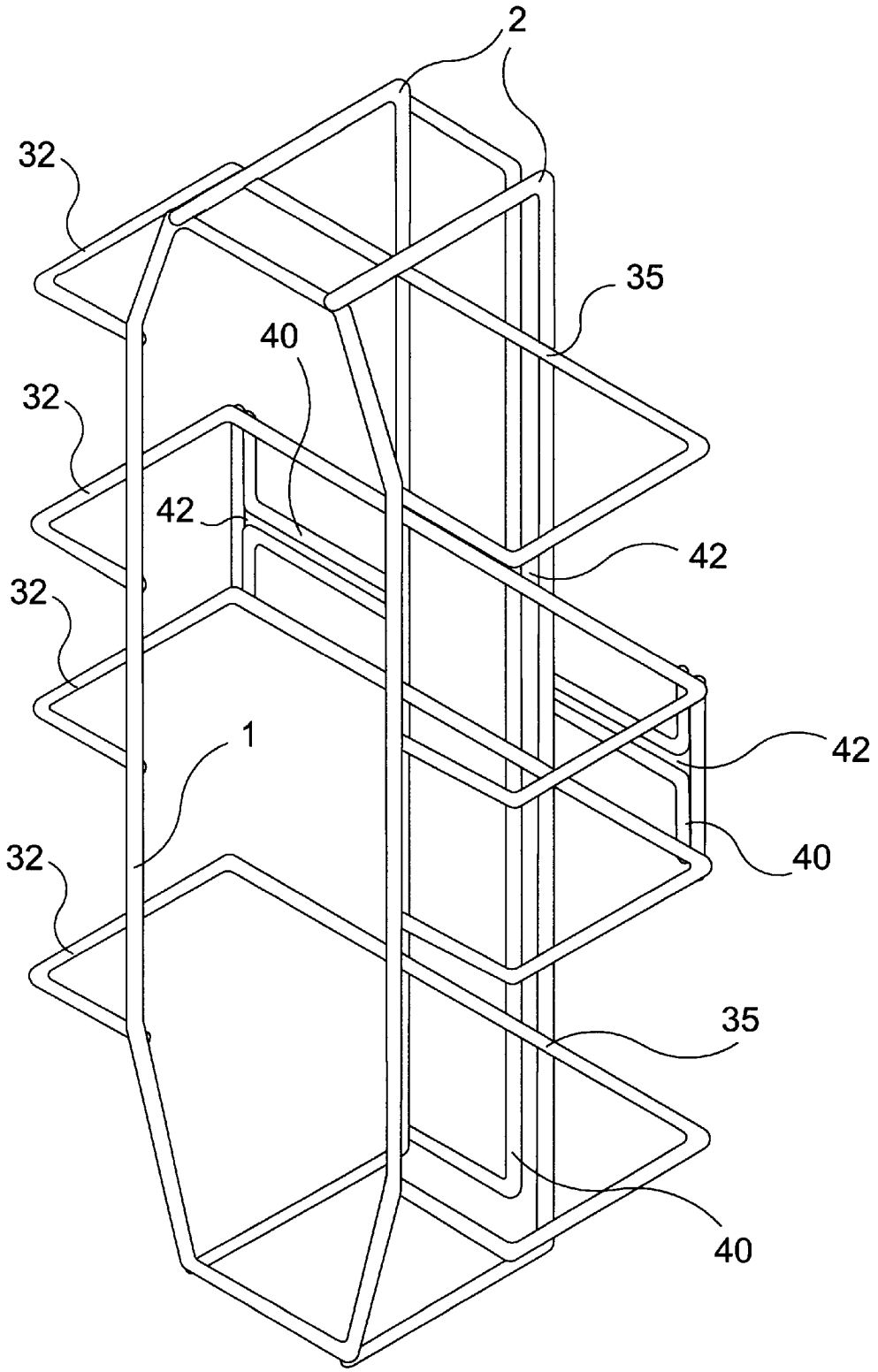
FIG. 6 is a perspective view of an embodiment of the present invention.

Another embodiment of a single basket hose storage apparatus of the subject invention comprises substantially C-shaped and U-shaped support members having both substantially vertical and horizontal sections, and first and second ends attached to an upper frame member to define the base of the hose storage apparatus. As illustrated in FIG. 6, the subject apparatus comprises at least a first U-shaped support member 2 in substantial axial alignment with the long axis of an upper frame member 1 and at least a first substantially C-shaped support member 32 in substantial axial alignment with the short axis of the upper frame member 1, such that the horizontal section of the U-shaped and C-shaped support members are substantially in parallel plane or coplanar. More preferably, the base comprises at least two U-shaped support members 2 in substantial axial alignment with the long axis of the upper frame member 1 and at least two C-shaped support members 32 in substantial axial alignment with the short axis of the upper frame member 1. Most preferably, the base comprises at least four C-shaped support members 32. Optionally, a point of intersection 35 between a U-shaped support member 2 and a C-shaped support member 32 can be welded or fastened together by conventional means. Typically, points of intersection 35 between a U-shaped support member 2 with a C-shaped support member 32 are connected or integrated together.

Means for retaining a coiled hose in a storage device of the present invention can be attached to the upper frame member 1. In a preferred embodiment, as illustrated in the FIGS. 2, 3 and 5, the hose retention means comprises a hose retention member 5 having first and second ends which directly attach to the upper frame member 1 and functions to hold coiled hose in place in the storage device. A hose retention member 5 can be permanently or removably attached to an upper frame member. Preferably, multiple hose retention members 5 are attached substantially in plane with the upper frame member 1 and are oriented to be substantially perpendicular to the long axis of the upper frame member 1. Hose retention members attached to the upper frame member 1 in a orientation that is substantially perpendicular to the short axis of the upper frame 1 are also contemplated by the present invention. In a preferred embodiment, at least two hose retention members 5 are attached to the upper frame member 1; however, any number of hose retention members 5 are contemplated within the scope of the present invention. The position and shape of the hose retention members 5 can be any position or shape that provides for suitable retention of a hose when coiled into the hose storage apparatus.

Figure 5:
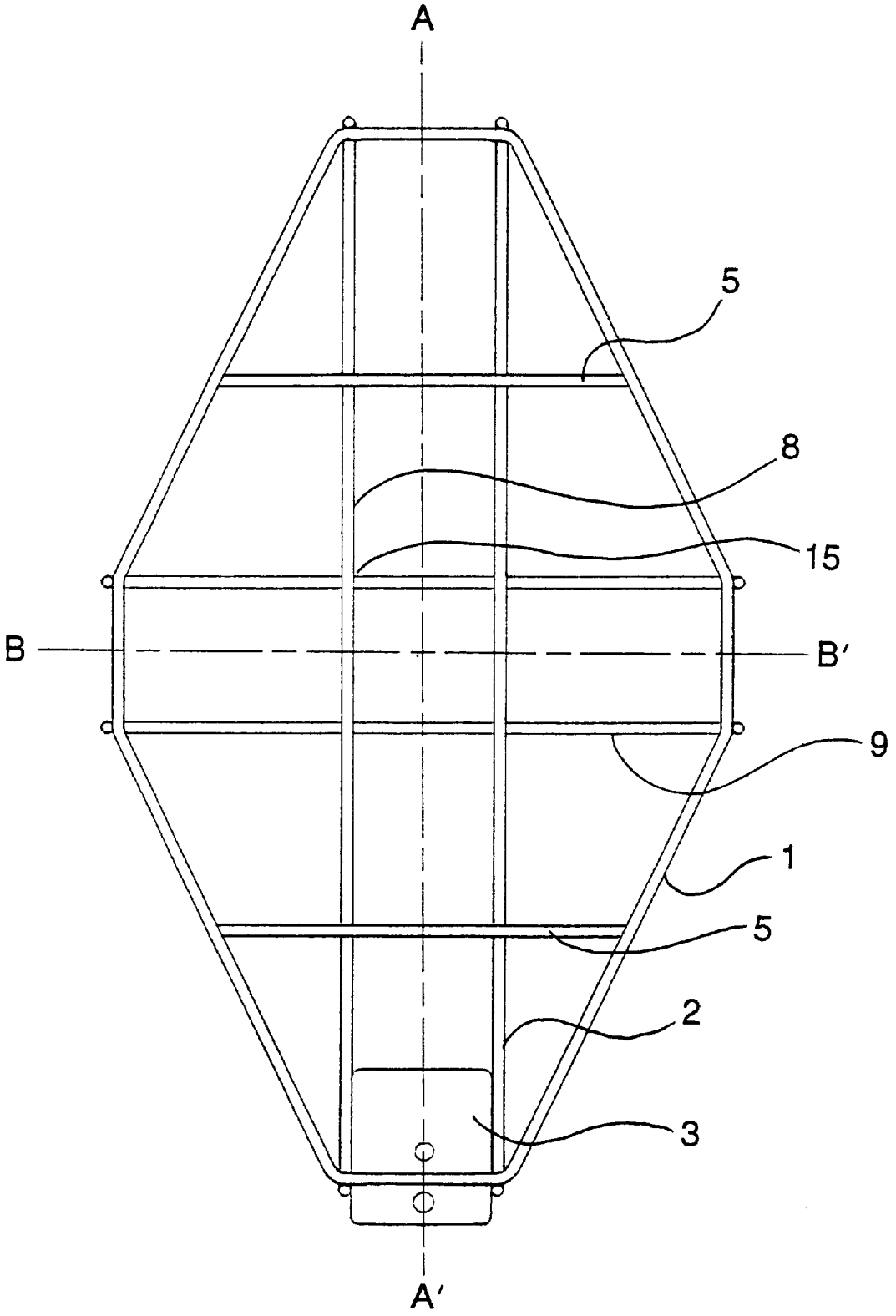
FIG. 5 is a top view of an alternate embodiment of a hose storage apparatus of the present invention.

Means for mounting the hose storage apparatus to another structure, for example, the frame of a rescue or other power unit assembly, or to a rescue vehicle, such as by fixed mounting brackets 3 as exemplified in FIGS. 1 and 5, can be attached to the U-shaped support members 2. Means for mounting a hose storage apparatus to a frame also includes mounting bars, as exemplified in FIGS. 6, 8 and 9, which comprise a bar 40 or other means running in parallel and close proximity with a U-shaped support member 2 or a C-shaped support member 32, effectively forming a narrow mounting slot 42. This provides for easy, adjustable mounting of a hose storage apparatus on a frame of a power unit. Preferably, a mounting bar 40 is constructed of the same materials and in the same dimensions as a U-shaped support member 2 or a C-shaped support member 32. A nut, bolt (suitably dimensioned to fit through slot 42), washer and mounting clip assembly, or other means known in the art, can be used to adjustably fasten the storage apparatus to a frame unit.

In a preferred embodiment, carrying handles 4 are attached to, or can be an integral portion of, the vertical section 7 of a U-shaped support member 2 or a mounting bracket 3. Carrying handles 4 can also be attached on the upper frame member 1. Carrying handles 4 can be of any design and construction that is suitable for providing a carrying means for transporting the hose storage device of the present invention as attached to the frame of a rescue unit. Preferably, the carrying handles 4 are of sufficient size and shape to accommodate gloved hands of rescue personnel.

The storage apparatus of the present invention can be mounted to a frame unit in either horizontal or vertical relation to the side of a frame unit, and it can be mounted on the top of the frame. FIG. 1 illustrates the hose storage device horizontally mounted to the top of a frame of the power unit. Optionally, a plurality of individual storage devices of the present invention can be mounted on a single frame of a rescue unit For example, two hose storage devices can be mounted on a frame unit, wherein the storage devices can be vertically or horizontally mounted on the frame. Alternatively, a single storage device can be horizontally mounted on the top of the frame unit, and a second storage device mounted on the side of the frame unit.

Figure 4:
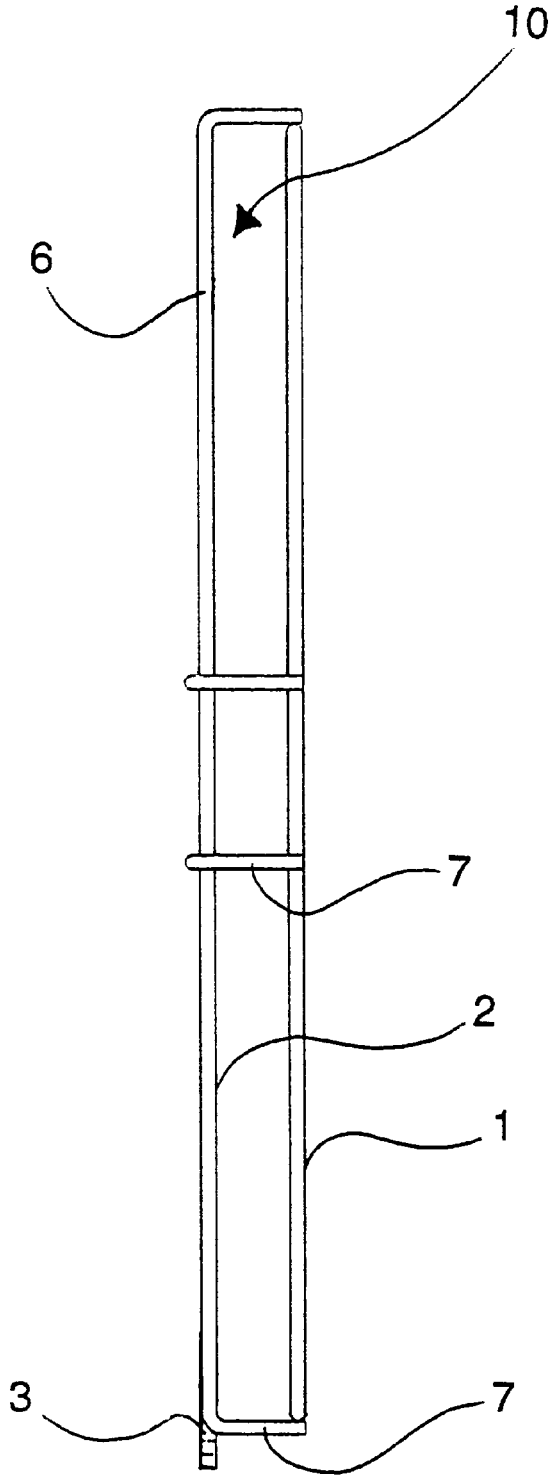
FIG. 4 is a side view of an alternate embodiment of a hose storage apparatus of the present invention.

FIGS. 4 and 5 illustrate one embodiment of the hose storage device of the invention adapted for mounting vertically on a frame unit. As illustrated, the storage device has greater extension about the long axis (shown as A–A' in FIG. 5) of the upper frame member 1 relative to the short axis (shown as B–B' in FIG. 5). Mounting brackets 3 are attached to the horizontal section of a U-shaped support member 2.

Figure 7:
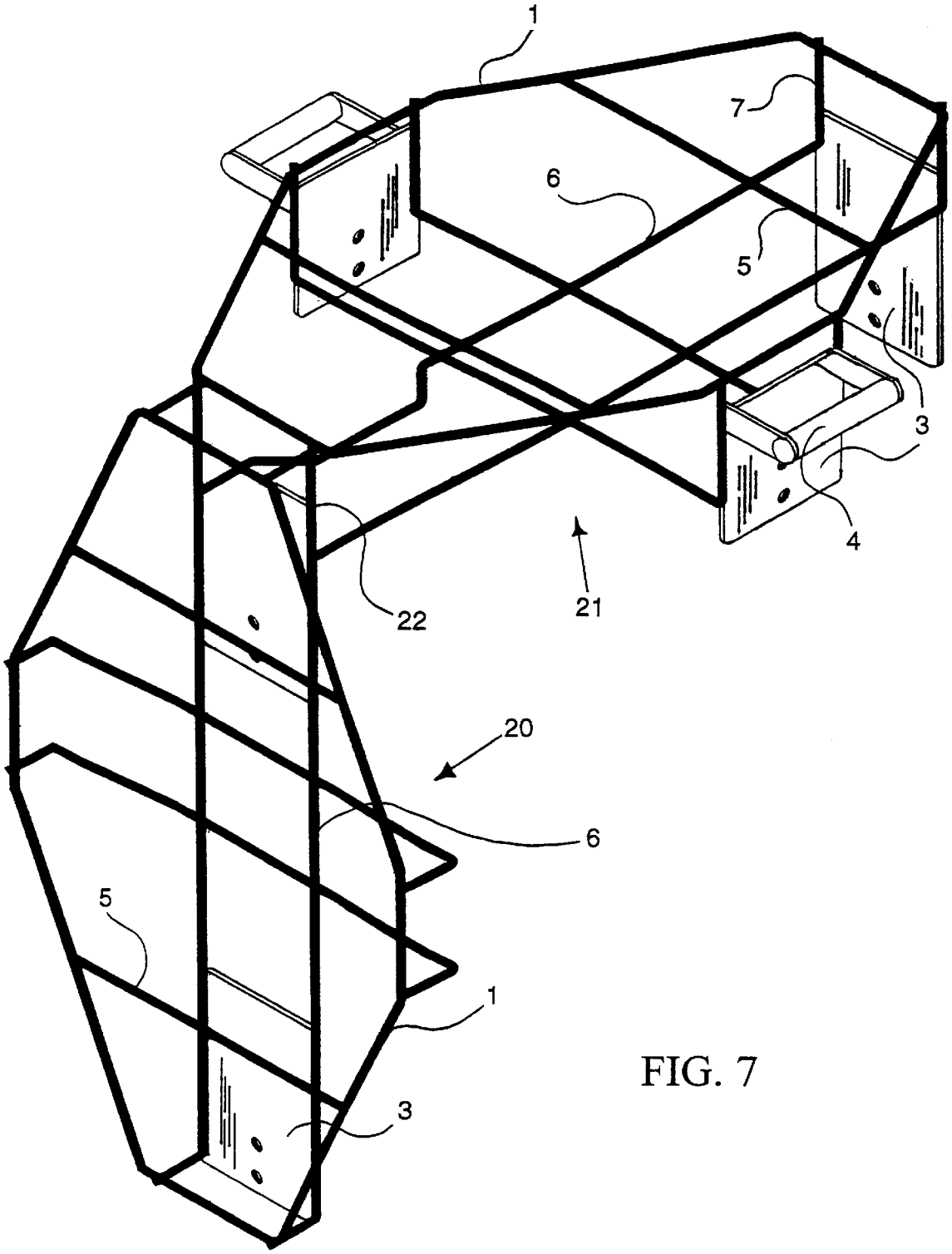
FIG. 7 is a perspective view of a double basket embodiment of the present invention, wherein multiple hose storage devices are configured together for mounting on the frame of a rescue unit.

One embodiment of a double basket hose storage apparatus for mounting on the frame of a rescue or power unit and providing for multiple hose storage capacity with that unit is shown in FIG. 7. In this embodiment, the hose storage apparatus provides for compact and efficient storage of two separate hose lines with a portable rescue or power unit As exemplified, this embodiment comprises two individual hose storage devices 20, 21 connected together at right angles to each other, wherein one individual storage device 20 is vertically oriented relative to the other, horizontally-oriented, storage device 21. In this embodiment, a bridging support member 22 is formed by a horizontal section of a U-shaped support member of the vertically oriented device 20 which is integrated with the vertical section of a U-shaped support member of the horizontally oriented device 21. Mounting brackets 3 attached to the U-shaped support members 2 allow for additional points of attachment between the hose storage apparatus and the frame of the portable rescue unit. The mounting brackets 3 can be positioned at any suitable location on the U-shaped support members 2, including both the vertical 7 and horizontal 6 sections, that will allow for attachment of the device to a particular frame unit. Optionally, carrying handles 4 can be mounted on the upper frame member 1 or on the U-shaped support member 2. Multiple hose retention members 5 are shown on the apparatus.

The present invention also concerns another embodiment of a double basket hose storage apparatus for mounting on a rescue vehicle or the frame of a power unit and providing for multiple hose storage capacity with that unit. A first and a second single basket hose storage device, as exemplified in FIG. 6, are symmetrically aligned side by side and attached to each other where each of the C-shaped support members 32 of the first device abuts against the corresponding C-shaped members 32 of the second device. Attachment can be by any suitable means, including, for example, welding. In a preferred embodiment, two U-shaped support members 2 and four C-shaped support members 32 comprise the base of each of the first and second hose storage devices. The baskets of the hose storage devices can also be held together or attached via a carrying handle 4 and/or a brace member 52 spanning the vertically oriented section 7 of U-shaped support members 2 of each individual basket.

Figure 8:
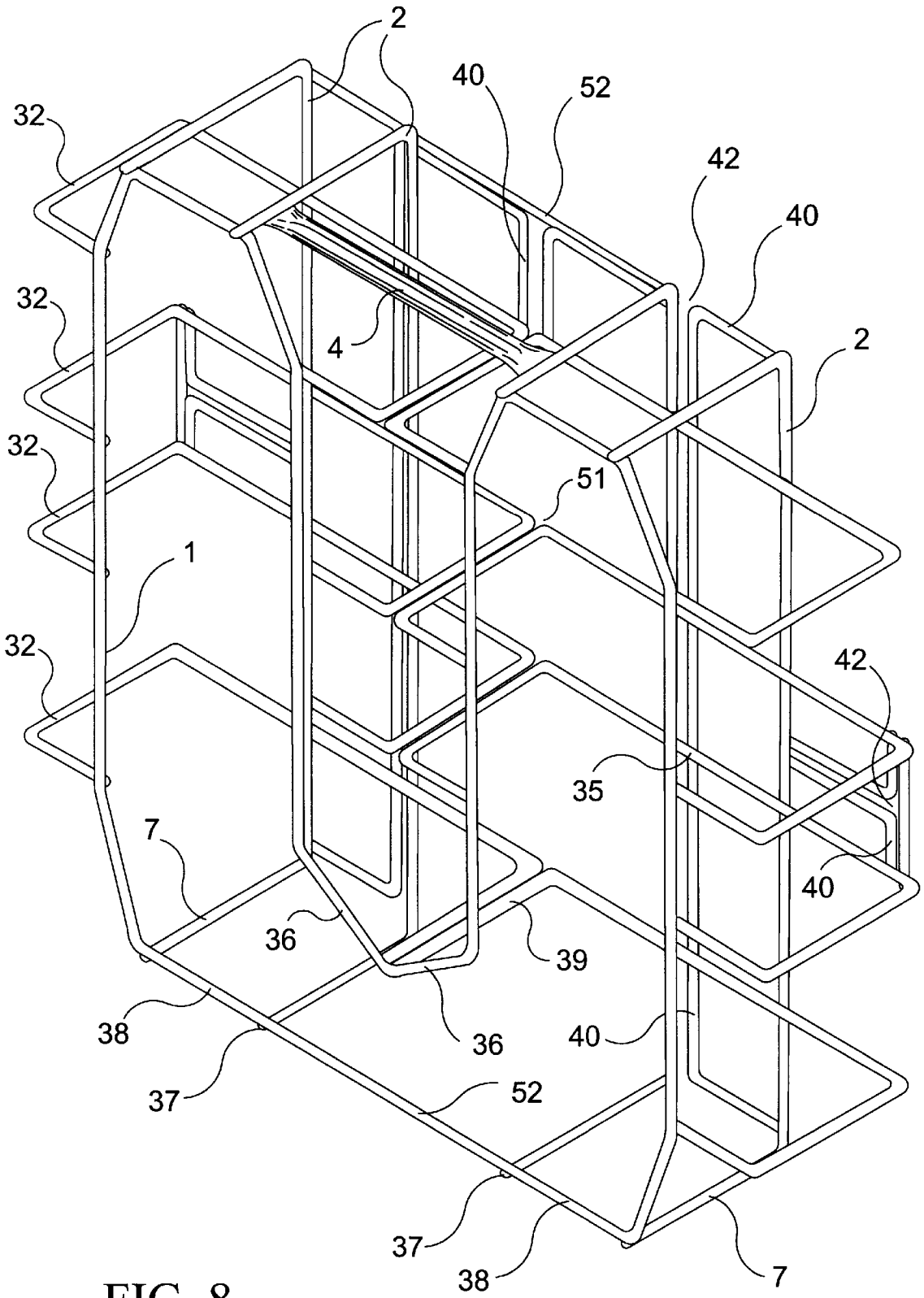
FIG. 8 is a perspective view of a double basket embodiment of a hose storage apparatus of the present invention, wherein multiple hose storage devices are configured together for mounting on the frame of a rescue unit.
Figure 9:
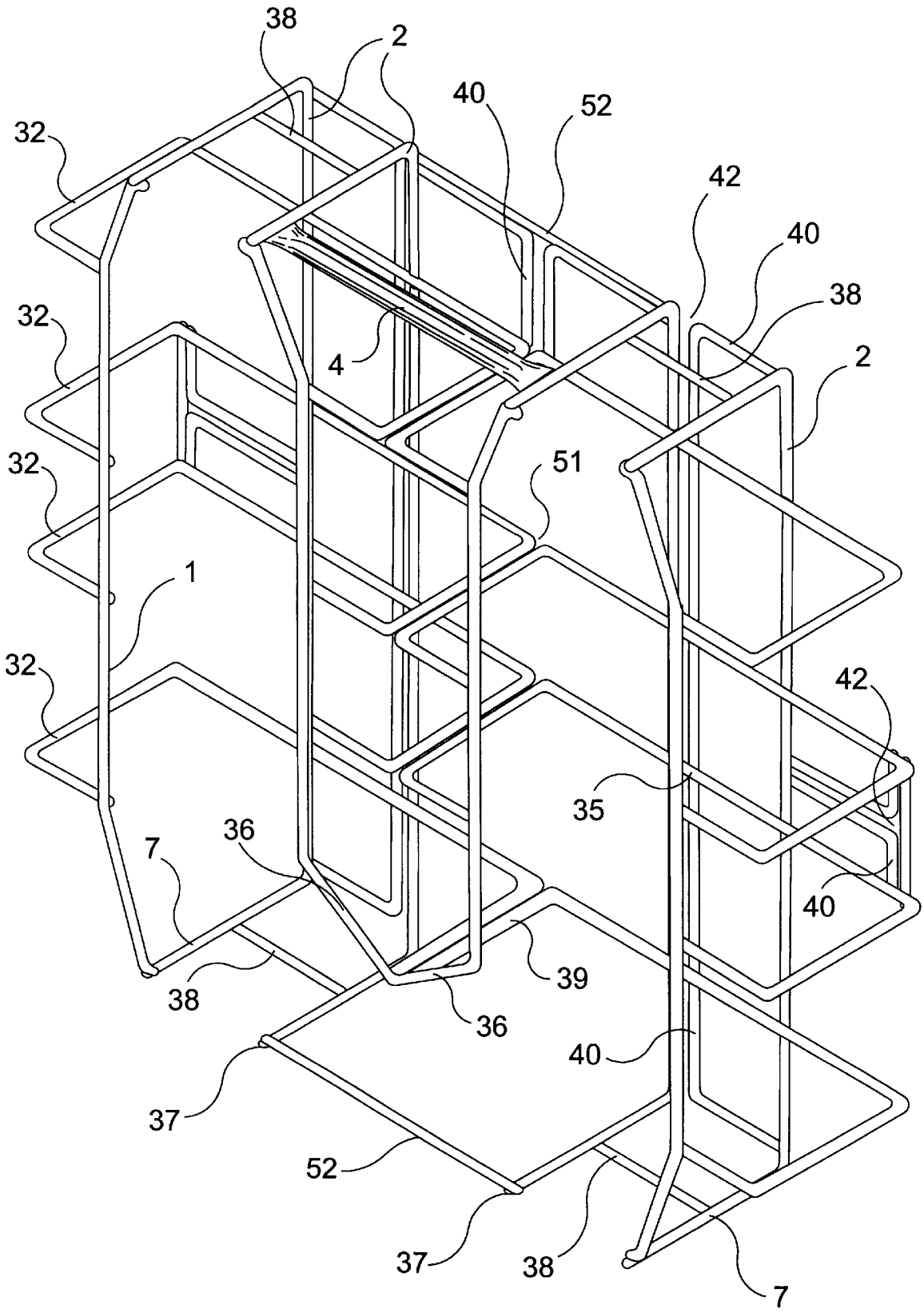
FIG. 9 is a perspective view of a double basket embodiment of a hose storage apparatus of the present invention, wherein multiple hose storage devices are configured together for mounting on the frame of a rescue unit.

An alternate embodiment of a double basket hose storage apparatus, as exemplified in FIG. 8, provides for compact and efficient storage of two separate hose lines, and is particularly adapted for use in conjunction with reel-type hose storage devices that are fixedly mounted on a fire or rescue vehicle. In this embodiment, an upper frame member 1 forms a partial or open ring structure, wherein a portion of the upper frame member ring structure does not connect between a terminal portion 36 of a C-shaped support member 32 and an end 37 of a U-shaped support member 2. The terminal portion 36 of the C-shaped support member 32 can be angled upward, as shown in FIGS. 8 and 9, to connect with the upper frame member 1. This design permits an open, unobstructed connection between the two baskets, allowing hose to be coiled directly from one basket of the apparatus to the other basket. As can be readily understood, an equivalent construction of this embodiment of the apparatus can be prepared by replacing terminal portion 36 of the C-shaped support member 32 with a portion of the upper frame member 1 angled out from the center of the ring structure to attach to an end of the vertically oriented section 39 of the C-shaped support member 32. Another equivalent construction of this embodiment can be prepared by replacing a terminal portion 36 of the C-shaped support member 32 and having a single upper frame member 1 attach to the ends of each C-shaped 32 and U-shaped 2 support members that form the base of each of the first and second hose storage baskets in the double basket apparatus. In a preferred embodiment, a section 38 of the upper frame member 1 that contacts the ends 37 of the U-shaped support members 2 can be fixedly attached at a position anywhere between the vertically oriented section 7 of the U-shaped support members 2, as shown in FIG. 9.

Typically, the present hose storage devices are used with a main hose that attaches to a hose coupling that provides for two hoses (i.e., first and second post-coupling hoses) out of a single main hose and, thus, allows for two rescue tools to be used at the same time from a single power unit. When a double basket hose storage apparatus is used in conjunction with a reel-type hose storage device holding the main hose, and the first and second hoses are stored preconnected to rescue tools, then the first and second hose is typically stored in the baskets by coiling the hoses in a figure-8 pattern between the two baskets. Alternatively, when the first and second hoses are not stored preconnected to rescue tools, then the first and second hose can be coiled separately into each basket of the apparatus. When a double basket hose storage apparatus is used with a portable power unit and the main hose must be stored in the apparatus, then the main hose is typically brought in from bottom end of the apparatus and coiled in a figure-8 pattern between the two baskets, the coupling placed in the side of a basket and the first and second hoses coiled separately into each basket of the apparatus.

The size of a hose storage apparatus according to the subject invention can be designed to accommodate the amount of hose to be stored with a given rescue unit. The skilled artisan understands that the available hose storage space for a given hose storage apparatus of the present invention is dependent on the length, width and depth of the apparatus. The hose storage devices of the present invention are designed to work with numerous types of hoses and lines, including, for example, standard 20,000 and 40,000 PSI hoses used with hydraulic rescue tools.

The structure of the hose storage apparatus of the present invention can be composed of any number of suitable materials including iron, steel, high-strength plastic polymers, etc. Typically, the structural material is composed of a metal or metal alloy. Preferably, the structural material is a steel or an aluminum alloy wire. Optionally, the structural material can be coated with any suitable material that will enhance the durability and integrity of the apparatus. For example, if the material is metal it can be powder-coat finished according to standard methods known in the art. The structural members of the device can be either solid or hollow in design construction, and can be substantially any shape, for example, circular, oval, rectangular, triangular or square, when viewed in cross-section perpendicular to the long axis of the member. While construction of the hose storage devices with structural members of circular cross-section is exemplified, the subject invention also contemplates construction with structural members that are formed as substantially flat or sheet-like pieces. Thus, the apparatus can be constructed as an open frame, such as, for example, with tubular or rod-like structural members, or as a closed frame, such as, for example, with connected or continuous sheet-like structural members.

Advantageously, the open design of the hose storage apparatus allows for easy access to the power unit for maintenance and repair. In addition, the subject storage apparatus, unlike reel-type storage devices, provides for greater reliability since there are no moving parts to breakdown. The hose storage apparatus of the present invention also allows for preconnection of the hydraulic hose lines to the power unit of the rescue unit, which thereby avoids having to connect the hoses to the power unit when the rescue unit is placed in operation. This saves valuable time for rescue personnel during rescue tool set-up at an accident site.

The hose storage apparatus of the present invention can also be used with other portable devices that require hoses, cords, or lines in their operation. For example, the subject invention can be used for hose and line management with machines such as air compressors, high pressure spray washers and the like.

The subject invention also concerns methods for storing and deploying a hydraulic hose. In a preferred embodiment, a hydraulic hose is preconnected to the power unit of a rescue device and the hose is coiled in a continuous loop into the hose storage apparatus. When a storage apparatus of the present invention is used on a portable power unit, then preferably the hose is placed into the basket from the bottom of the apparatus and then run up the side to begin the coil. Preferably, the hose is coiled from the periphery of the apparatus inward toward the center. When a storage apparatus is used in conjunction with a reel system, then preferably the apparatus is mounted nearby the reel system and hydraulic hose from the reel is placed into a hose basket from the top of the apparatus. Once the hose is coiled into the storage apparatus, the supply line end and return line end of the hydraulic hose can be inserted and stored in a swivel sock according to the present invention, or the ends can be connected together via hose coupling means, and the hose held in place in the storage apparatus. Alternatively, a rescue tool can be left connected to the end of the hydraulic hose and stored nearby the hose storage apparatus.

The hose can be rapidly deployed from the hose storage apparatus by manually pulling the end of hose from apparatus. In a preferred embodiment of the method of hose deployment, a means for removing or releasing hose twist during hose deployment is provided. In one embodiment, the means for releasing hose twist comprises a pull strap connected to a swivel member which is attached to the connected ends of the hydraulic hose, whereby as the hose is pulled from the storage device substantially all of the twist present in the coiled hose can be released since the hose can freely rotate or swivel about its longitudinal axis during hose deployment. In further embodiment, the means comprises a swivel sock with grab straps as described in detail below. Other means for allowing the hose to freely rotate about its longitudinal axis while applying a pulling force on the hose during deployment are known in the art and are contemplated within the scope of the present invention. The simultaneous removal of hose twist during hose deployment decreases the amount of time required for rescue personnel to place a rescue tool in operation. After use, when coiling the hose into the subject storage apparatus, a light tension can be maintained on the hose using the swivel member. This allows a person to easily place any necessary twist in the hose while coiling the hose back into the subject apparatus for storage.

Figure 10:
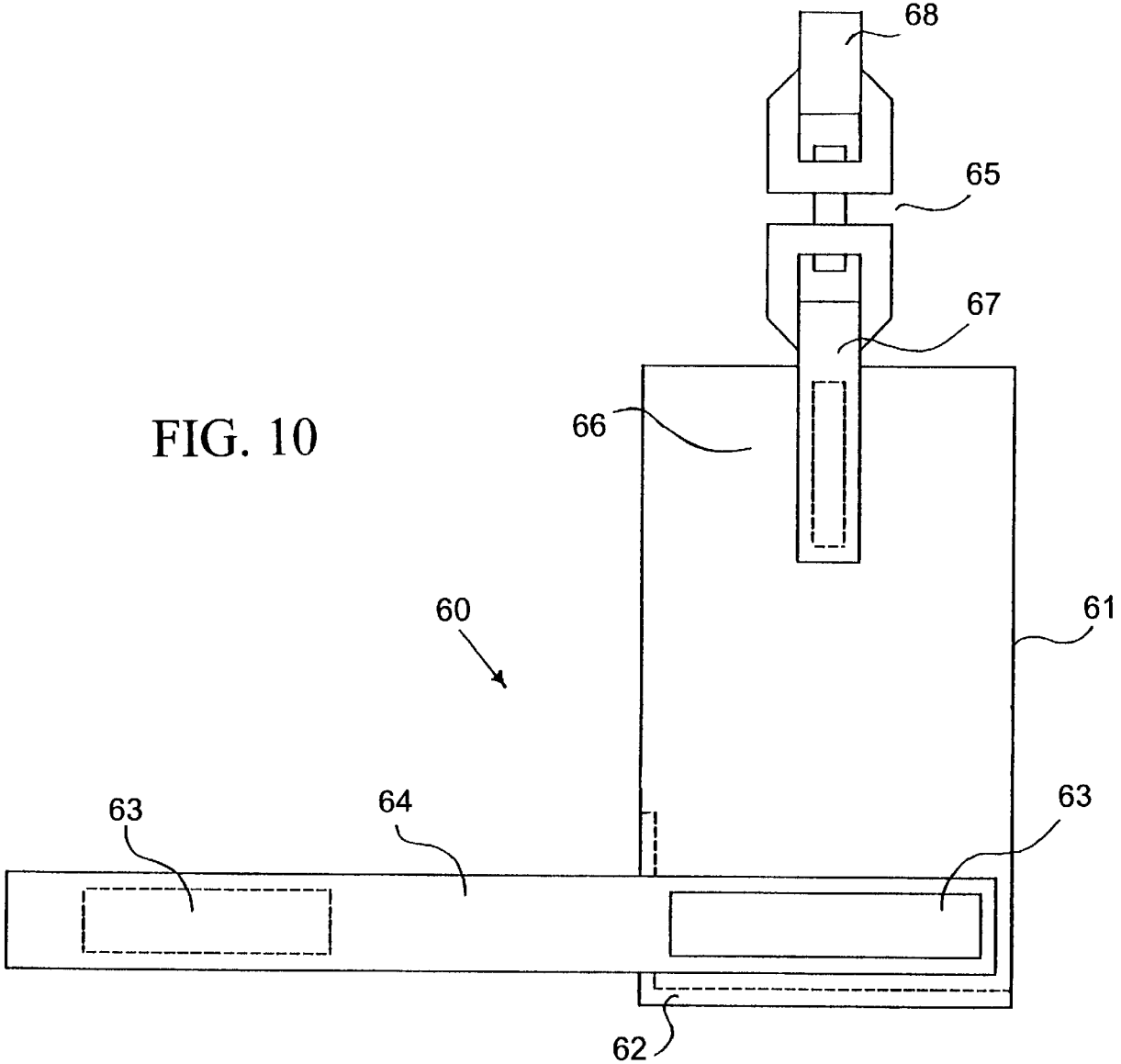
FIG. 10 is a front view of a swivel sock according to the present invention.

The present invention also concerns a swivel sock for use with the methods of the invention for storing and deploying hydraulic hose. With reference to FIG. 10, a swivel sock of the present invention comprises a bag 61 formed in any suitable shape and adapted for enclosing the couplings on the end of a hydraulic hose, having a first and second side attached together and forming an opening 62 at one end thereof. In the exemplified embodiment, the bag 61 is substantially rectangular in shape. Attached to the bag near the open end are means for closing the open end of the bag. Typically, the closing means comprises, for example, a hook and loop type fastener system 63, e.g. VELCRO, attached directly to the end of the bag 61 having the opening 62 therein or to a cinch strap 64 attached to the end of the bag 61 having the opening 62 therein. The closing means can also be a drawstring at the end of the bag 61 having the opening 62 therein. In a preferred embodiment, a means for removing or releasing hose-twist during hose deployment is provided on the swivel sock. Preferably, the means for releasing hose-twist comprises a swivel member 65 or other similar means attached to a closed end 66 of bag 61 by conventional attachment means. Typically, the attachment means comprises a strap, such as, for example, attachment strap 67, sewn or attached to each side of the bag and attached to an end of the swivel member. A grab strap 68 is attached to an end of the swivel member opposite the end of the swivel member having attachment strap 67 attached thereto. In use, the hydraulic hose couplings are inserted into the open end of the bag and the open end cinched tight around the hose, thereby releasably containing the couplings within the closed bag. The swivel sock can be made from any suitable material, including nylon, canvas, and cordura. Advantageously, the swivel sock of the present invention helps prevent damage to the hose couplings and keeps dirt and debris off the couplings when the hoses and rescue unit are not being used.

Although the foregoing invention has been described in some detail by example, the present invention is not limited to the particular description and specific embodiments provided herein. Thus, it should be understood that the examples and embodiments described herein are for illustrative purposes only and that various modifications, substitutions, variations, or changes in light thereof will be suggested to persons skilled in the art and are to be included within the spirit and purview of this application and the scope of the appended claims.

REFERENCES

U.S. Pat. No. 5,243,761 issued to Sullivan et al.

U.S. Pat. No. 5,421,533 issued to Scott et al.

We claim:

1. A single basket, opened frame hose storage apparatus comprising an upper frame member, wherein said upper frame member forms a ring structure, and a base defined by a plurality of substantially U-shaped and C-shaped support members each having both substantially vertical and horizontal sections and a first and a second end, wherein said first and second ends of said support members are directly attached to said upper frame member.

2. The hose storage apparatus according to claim 1, wherein said upper frame member has a long axis and a short axis, wherein said long and short axes are coplanar.

3. The hose storage apparatus according to claim 2, wherein at least a first U-shaped support member is in substantial axial alignment with the long axis of said upper frame member and at least a first C-shaped support member is in substantial axial alignment with the short axis of said upper frame member.

4. The hose storage apparatus according to claim 3, comprising at least two of said U-shaped support members and at least two of said C-shaped support members, wherein said U-shaped support members are in substantial axial alignment with the long axis of said upper frame member and wherein said C-shaped support members are in substantial axial alignment with the short axis of said upper frame member.

5. The hose storage apparatus according to claim 4, wherein said horizontal sections of said U-shaped support members and said C-shaped support members are substantially in parallel planes, and are attached to each other at the points of intersection of said horizontal section of said U-shaped and C-shaped support members.

6. The hose storage apparatus according to claim 1, further comprising means for mounting said hose storage apparatus to a structure.

7. The hose storage apparatus according to claim 6, wherein said mounting means comprises mounting brackets, wherein said mounting brackets are attached to said U-shaped support members.

8. The hose storage apparatus according to claim 6, wherein said mounting means comprises mounting bars, wherein said bars are mounted in parallel and close proximity with said U-shaped support members or said C-shaped support members, thereby forming a mounting slot.

9. The hose storage apparatus according to claim 1, further comprising handles for carrying and transporting said hose storage apparatus.

10. A hose storage apparatus for storing a plurality of hoses, comprising a first and second hose storage apparatus attached together, said first and second apparatus each being an opened frame apparatus comprising an upper frame member, wherein said upper frame member forms a ring structure, and a base defined by a plurality of substantially U-shaped and C-shaped support members each having both substantially vertical and horizontal sections and a first and a second end, wherein said first and second ends of said supports members are directly attached to said upper frame member.

11. The hose storage apparatus according to claim 10, said apparatus wherein each upper frame member forms a partial or open ring structure, wherein a portion of each upper frame member does not connect a terminal portion of one C-shaped support member with an end of one U-shaped support member.

12. The hose storage apparatus according to claim 11, wherein said terminal portion of said C-shaped support member is angled upward to connect with said upper frame member.

13. The hose storage apparatus according to claim 10, said apparatus wherein each upper frame member forms a partial or open ring structure, wherein a portion of each upper frame member does not connect a terminal portion of one C-shaped support member with an end of one U-shaped support member, and wherein said terminal portion of said C-shaped support member is replaced by a portion of said upper frame member angled out from the center of said upper frame member ring structure and attaching to an end of a vertically oriented section of said C-shaped support member.

14. The hose storage apparatus according to claim 10, wherein a terminal portion of one C-shaped support member is deleted, and wherein a single upper frame member attaches to the ends of each of said C-shaped and U-shaped support members that form the base of each of said first and second hose storage apparatus.

15. The hose storage apparatus according to claim 10, wherein a section of said upper frame member that contacts the ends of said U-shaped support members is fixedly attached at a position anywhere between the vertically oriented section of said U-shaped support members.

16. The hose storage apparatus according to claim 10, further comprising a brace member spanning the vertically oriented section of said U-shaped support members between the baskets of said first and second hose storage apparatus.

17. The hose storage apparatus according to claim 10, further comprising means for mounting said hose storage apparatus to a structure.

18. The hose storage apparatus according to claim 17, wherein said mounting means comprises mounting brackets, wherein said mounting brackets are attached to said U-shaped support members.

19. The hose storage apparatus according to claim 17, wherein said mounting means comprises mounting bars, wherein said bars are mounted in parallel and close proximity with said U-shaped support members or said C-shaped support members, thereby forming a mounting slot.

20. The hose storage apparatus according to claim 10, further comprising handles for carrying and transporting said hose storage apparatus.

* * * * *

UNITED STATES PATENT AND TRADEMARK OFFICE

CERTIFICATE OF CORRECTION

PATENT : 6,062,503

DATED : May 16, 2000

INVENTOR(S) : William Blake Blair and Daniel Godfrey

It is certified that error appears in the above-identified patent and that said Letters Patent is hereby corrected as shown below:

Column 5, line 47: "unit For example" should read --unit. For example--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*